United States Patent [19]

Rösl et al.

[11] Patent Number: 4,894,494

[45] Date of Patent: Jan. 16, 1990

[54] PULSE GENERATOR

[75] Inventors: Wolfgang Rösl, Eckental; Jochen Rose, Röthenbach, both of Fed. Rep. of Germany

[73] Assignee: Alcatel N.V., Amsterdam, Netherlands

[21] Appl. No.: 220,429

[22] Filed: Jul. 13, 1988

[30] Foreign Application Priority Data

Jul. 28, 1987 [DE] Fed. Rep. of Germany ..... 3724898
Nov. 20, 1987 [DE] Fed. Rep. of Germany ..... 3739296

[51] Int. Cl.[4] ..... H01H 19/20
[52] U.S. Cl. ..... 200/11 R; 307/106
[58] Field of Search ..... 200/11 R; 307/106

[56] References Cited

U.S. PATENT DOCUMENTS 4,282,415 8/1981 Shimizu et al. ..... 200/11 G
4,511,770 4/1985 Hayashida ..... 200/11 R
4,801,814 1/1989 Rose et al. ..... 200/11 R

FOREIGN PATENT DOCUMENTS 0229306 12/1986 European Pat. Off. .
1929087 12/1965 Fed. Rep. of Germany .
2595002 2/1986 France .

*Primary Examiner*—Derek S. Jennings
*Assistant Examiner*—Morris Ginsburg
*Attorney, Agent, or Firm*—Spencer & Frank

[57] ABSTRACT

A pulse generator having a gear and an actuating member. The actuating member is made from insulating material. It is movable sideways and is forced against the gear by a compression spring, which also serves as a detent spring. This forces a projection into engagement with a tooth space in the rest position. The pulse generator is especially suited for producing current and voltage pulses for digital tuners.

14 Claims, 4 Drawing Sheets

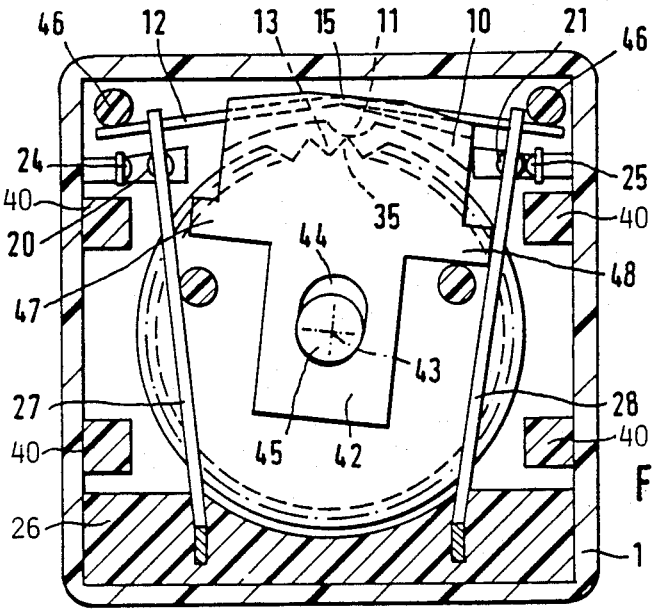
FIG.8
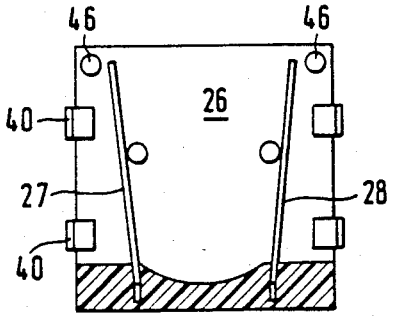
FIG. 9a
FIG. 9b
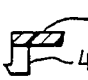
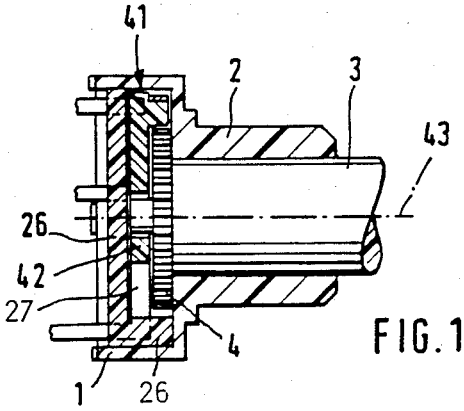
FIG.10

PULSE GENERATOR

BACKGROUND OF THE INVENTION

The present invention relates to a pulse generator.

A pulse generator of this kind is disclosed in U.S. Pat. No 4,282,415. The gear of that pulse generator is a rotor with a plurality of protrusions at equal intervals on the peripheral edge of the front face thereof. The actuating member, which is slidable only laterally, is made from a strip of resilient metal which is bent into an elongate rectangle. A bulge formed on one of the long sides of the actuating member engages a space between two protrusions in the rest position. In the rest position, the gear is locked by a specially shaped leaf spring which cooperates with axial protrusions formed on the rear side of the rotor. As the actuating member is made of metal, it must, in the rest position, be separated from both contacts by such a distance that flashover is avoided.

It is the object of the present invention to design a pulse generator of the above kind in such a way that the actuating member can be close to, or even touch, the contact springs. Furthermore, the pulse generator is to be inexpensive and easy to assemble.

SUMMARY OF THE INVENTION

This object and others to become apparent as the specification progresses, are accomplished by the invention according to which, briefly stated is a pulse generator having a gear and an actuating member, a projection of which is in non-positive engagement with a tooth space of the gear in the rest position. The actuating member is deflectable toward one side or the other depending on the direction of rotation of the gear. The actuating member is capable of actuating one of two laterally disposed contacts in each of its deflected positions. It is made of insulating material and is movable both sideways and in the direction of the teeth of the gear. A compression spring, designed as a pressure and restoring spring, is provided. It presses the actuating member against the teeth of the gear and this forces the projection into engagement with the tooth space in the rest position.

The actuating member can extend up to or close to the adjacent contact spring without the risk of a short circuit. In addition, when the gear is rotated, the contact spring is actuated practically immediately because no space is necessary between the actuating member and the contact spring. Finally, the two-dimensional deflectability of the actuating member permits the pressure of the compression spring to be varied within wider limits than would be possible with an actuating member made from resilient metal strip. Because of structural transformations of the metal, a multiply bent metal strip would reach no precisely defined values, so that relatively large tolerances may occur in a batch of actuating members. Furthermore, no additional restoring spring need be provided.

Embodiments of the invention will now be described with reference to the accompanying drawings.

BRIEF DESCRIPTION OF THE DRAWINGS

FIGS. 6 to 8 are sectional views of a pulse generator of a design similar to that of FIGS. 1 to 5, in different operating positions.

FIG. 9*a* is a front view (partially in section) of a contact plate for the pulse generator of FIGS. 6 to 8.

FIG. 9*b* is a partial sectional view of the plate of FIG. 9*a* showing only the housing engaging pin or lug.

FIG. 10 is sectional side view of the pulse generator of FIGS. 6 to 8.

DESCRIPTION OF THE PREFERRED EMBODIMENTS

Figure 1:
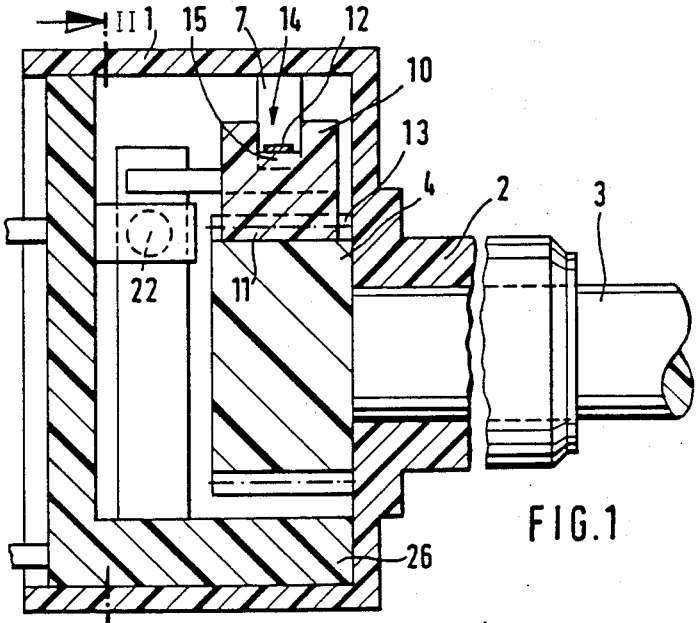
FIG. 1 is a sectional side view of a pulse generator taken along line I—I of FIG. 2.
Figure 2:
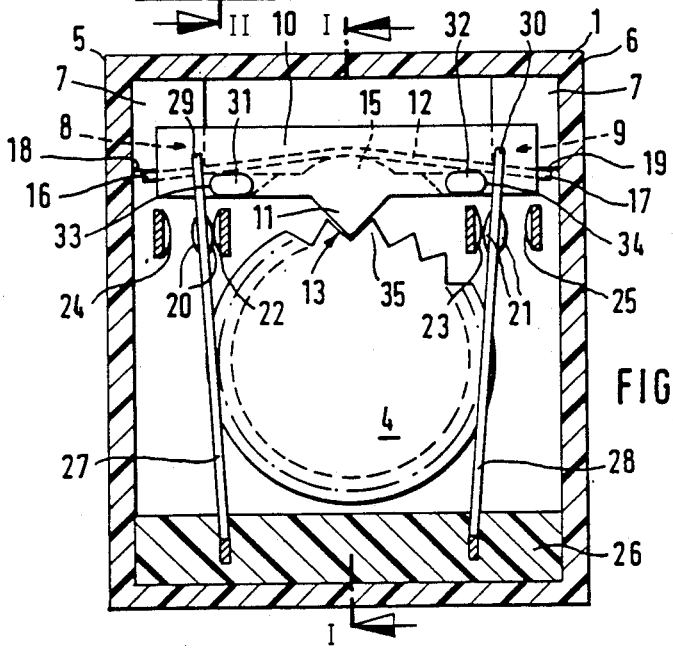
FIG. 2 is a section of the pulse generator taken along line II—II of FIG. 1, with the contacts in the rest position.
Figure 3:
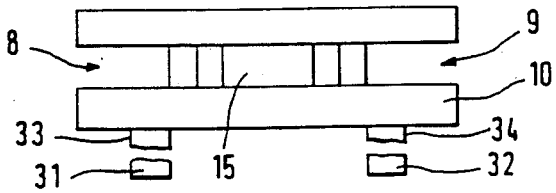
FIG. 3 is a top view of an actuating member.

In FIG. 1, the reference numeral 1 denotes a preferably tray- or cup-shaped housing part of a pulse generator which has an outwardly projecting bearing bush 2. The latter supports a shaft 3 having a gear 4 mounted on its inner end.

As shown in FIGS. 2 to 5, a guide portion 7 in the form of a plane-parallel plate is provided in each of the two upper corners 5 and 6 of the housing part 1. Each guide portion 7 is integrally formed on the housing part 1 during manufacture. The guide portions 7 and the teeth of the gear 4 lie in the same plane. Each of the guide portions 7 engages a coplanar lateral slot 8, 9 of bar- or beam-shaped actuating member 10 of insulating material with little play. The actuating member 10 has a downwardly pointing, preferably acute-angled projection 11, which engages a tooth space 13 of the gear 4 under the pretension of a compression spring 12.

The compression spring 12 is designed as a wire, bar, or leaf spring. It lies in a groove 14 of the actuating member 10 and crosses a rounded elevation 15, which is provided on the side of the actuating member 10 opposite the projection 11. Each end 16, 17 of the compression spring 12 rests against a lateral stop edge 18, 19 under pretension. In the embodiment shown, the stop edges are formed by the lower edges of the guide portions 7.

In a plane parallel to the gear 4 and the actuating member 10, a contact spring set consisting of a movable contact 20, 21, a stationary break contact 22, 23, and a stationary switching contacat 24, 25 is disposed on both sides of the tooth space 13. Each of the movable contacts 20, 21 is attached to a leaf spring 27, 28 fixed in a wall part 26, which can be fitted into the housing part 1. The free ends 29, 30 of the leaf springs 27, 28 extend beyond the associated contacts 20, 21 into the region of the actuating member 10. The latter is provided with two actuating lugs 31, 32, which project toward the associated leaf springs 27, 28, and whose outer edges 33, 34 are spaced a small distance from the associated leaf springs 27, 28 when the pulse generator is in the rest position. Instead of two actuating lugs 31, 32, a single lug of corresponding width may be provided.

Figure 4:
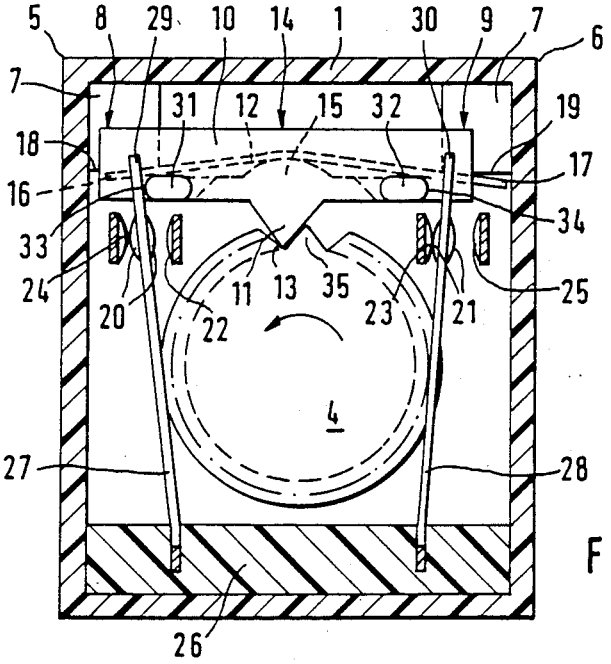
FIGS. 4 and 5 show different positions of the moving parts during an actuation for generating a pulse.

The operation of the pulse generator is as follows. When the gear 4 is rotated counterclockwise, the actuating member 10 is first moved to the left by the right tooth 35, so that the outer edge 33 of the actuating lug 31 comes into contact with the free end 29 of the leaf spring 27 and forces the latter to the left. Thus the break contact 20, 22 is opened and the switching contact 20, 24 is closed. This condition is shown in FIG. 4.

Figure 5:
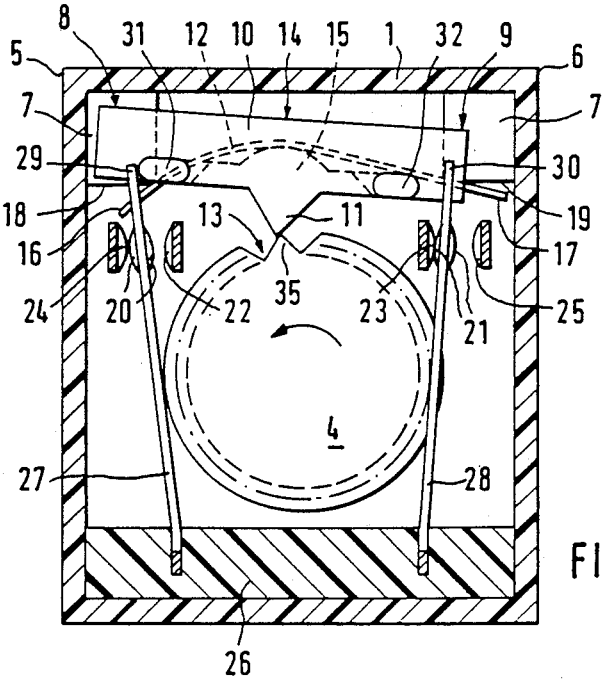

As the gear 4 is further rotated counterclockwise, the projection 11 moves up the flank of the tooth 35, as shown in FIG. 5. As a result, the actuating member 10 is lifted on the contact-making side, with the actuating lug 31 sliding upwards along the free end 29 of the leaf spring 27. As the gear 4 is further rotated, the projection 11 moves over the crest of the tooth 35 and engages the next tooth space, with the actuating member 10 assuming its rest position and the movable contact 20 moving against the break contact 22. With each deflection of the actuating member 10, the break contact is thus opened and the switching contact closed, so that a positive pulse and/or a negative pulse can be produced.

When the gear 4 is rotated clockwise, an analogous switching sequence takes place for the right-hand contact spring set (21, 23, 25).

Figure 6:
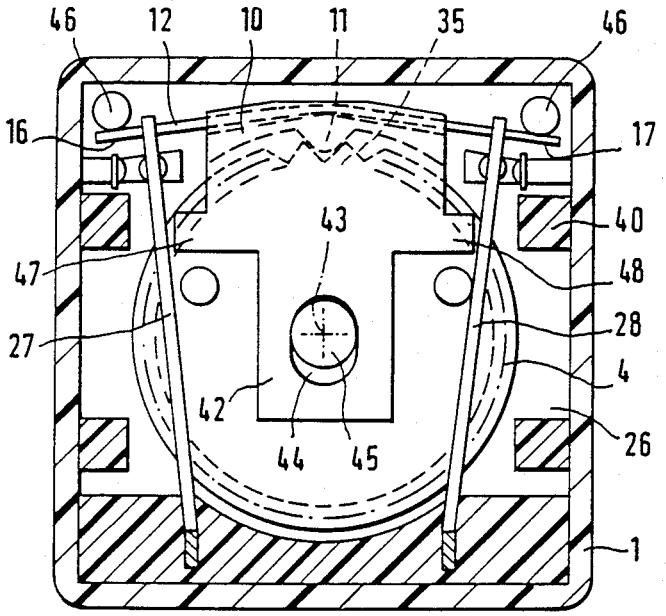
Figure 7:
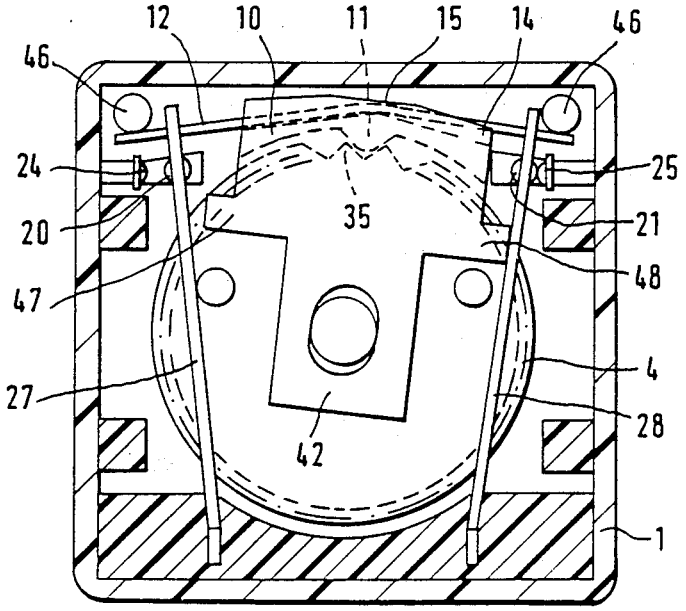

Another embodiment of the invention will now be described with the aid of FIGS. 6 to 10, in which parts having similar functions as in the embodiment of FIGS. 1 to 5 are designated by similar reference characters. FIGS. 6 to 8 are sectional views like FIGS. 2 to 5 but show the operable parts in different positions.

A wall part 26, designed as a contact plate and supporting leaf springs 27 and 28 (FIG. 9), is fitted in the housing part 1. The wall part 26 is provided with rectangular pins or lugs 40, which enter corresponding recesses (not visible in this figure) of the housing part 1 to fasten the parts 1 and 26 together.

A shackle-like extension 42 of the actuating member 10 extends into a space 41 between the wall part 26 and the gear 4. The extension 42 is provided with an oblong hole 44, which extends in the direction of a line from the shaft 42 of the gear 4 to a projection 11 of the actuating member 10, and into which extends a journal 45, which is provided on, preferably formed integrally with, the shaft 3. Similarly, the gear 4 may be integrally formed with the shaft 3. The extension 42 thus pivots on the journal 45 and is movable in the direction of the line described.

On its side opposite of the projection 11, the actuating member 10 is provided with a groove 14 in which a leaf spring 12 rests under pretension. The bottom of the groove is slightly angled in the shape of a roof, so that an elevation 15 is formed. Each end 16, 17 of the leaf spring 12 rests against a stop pin 46. The projection 11 is thus forced into a tooth space of the gear 4, thereby locking the latter and, thus, the shaft in the position shown in FIG. 6.

The extension 42 has lateral projections 47, 48, which act on the associated leaf springs 27, 28 when the gear is rotated. Thus, the contacts 20, 24 can be closed and opened by rotating the gear counterclockwise, and the contacts 21, 25 can be closed and opened by rotating the gear clockwise.

The operation of the pulse generator is as follows.

When the gear 4 is rotated clockwise from the rest position shown in FIG. 6, the tooth 35 takes the projection 11 along, thereby moving the actuating member 10 to the right, so that the extension 42 pivots about the shaft 43. At the same time, the projection 48 strikes against the leaf spring 28 and deflects the latter to the right, so that the contacts 21, 25 are closed. This condition is shown in FIG. 7.

When the gear 4 is further rotated clockwise from the position of FIG. 7, the projection 11 moves up the flank of the tooth 35 and reaches the tooth crest, as shown in FIG. 8. The extension 42 thus moves upwards, too, with the journal 45 sliding in the oblong hole 44.

After the projection 11 has crossed the tooth crest, the gear 4 is locked in position as the projection 11 springs back and drops into the next tooth space 13, the leaf spring 28 being relieved of the pressure of the projection 48 and returning to its initial position, so that the contacts 21, 25 are opened.

When the gear is rotated counterclockwise, an analogous sequence of operations takes place.

We claim:

1. A pulse generator comprising a gear and an actuating member having a projection which engages a tooth space of the gear in the rest position and which is deflectable toward one side or the other depending on the direction of rotation of the gear, with said actuating member being capable of actuating one of two laterally disposed contacts in each of its deflected positions; and wherein: said actuating member is made of insulating material and is movable both sideways and in the direction of the teeth of the gear; a compression spring designed as a pressure and restoring spring is provided which presses said actuating member against the teeth of the gear and which forces the projection into engagement with the tooth space in the rest position; said actuating member is pivotable on a journal extending into an oblong hole of the actuating member, and movable in the direction of the line connecting the axis of rotation of the gear and the projection; and said journal is provided on a shaft of the gear.

2. A pulse generator as claimed in claim 1, wherein said journal and the shaft form a unit.

3. A pulse generator as claimed in claim 1, wherein said journal, the gear, and the shaft form a unit.

4. A pulse generator as claimed in claim 1 , wherein said actuating member is a T-shaped member the vertical portion of which is provided with the oblong hole, and the horizontal portion of which carries the projection.

5. A pulse generator as claimed in claim 4, wherein said vertical portion of said T-shaped member is movable between the gear and a housing wall in the direction of the plane of the housing wall.

6. A pulse generator as claimed in claim 1, wherein said compression spring is fixed between two lateral stop edges of a housing part and an elevation provided on the actuating member on the side opposite the projection.

7. A pulse generator as claimed in claim 1 wherein: said laterally disposed contacts are arranged in a plane parallel to the gear and the actuating member; and said actuating member has at least one actuating lug which projects toward a leaf spring of an associated movable contact and whose outer edge is located near the leaf spring of the associated movable contact in the rest position.

8. A pulse generator as claimed in claim 1, wherein said actuating member is provided on a side remote from the teeth with a groove in which the compression spring is inserted.

9. A pulse generator as claimed in claim 8, wherein said compression spring is a leaf spring.

10. A pulse generator as defined in claim 1, wherein each of said two laterally disposed contacts includes a respective stationary contact element and a respective movable contact mounted on a leat spring for movement toward an associated said stationary contact element in response to the deflection of said actuating member.

11. A pulse generator as claimed in claim 10, wherein: said laterally disposed contacts are arranged in a plane parallel to the gear and the actuating member; and said actuating member has at least one actuating lug which projects toward a respective said leaf spring of an associated movable contact and whose outer edge is located near the respective said leaf spring of the associated movable contact in the rest position.

12. A pulse generator comprising a gear, and an actuating member having a projection which engages a tooth space of the gear in the rest position and which is deflectable toward one side or the other depending on the direction of rotation of the gear, with said actuating member being capable of actuating one of two laterally member being capable of its deflected positions; and wherein: said actuating member is made of insulating material and is movable both sideways and in the direction of the teeth of the gear; a compression spring designed as a pressure and restoring spring is provided which presses said actuating member against the teeth of the gear and which forces the projection into engagement with the tooth space in the rest position; and said actuating member has a slot at each of its lateral ends which each engages a respective guide portion on a housing part with little play.

13. A pulse generator as claimed in claim 12, wherein said compression spring is fixed between two lateral stop edges of a housing part and an elevation provided on the actuating member on the side opposite the projection, and wherein said guide portion forms one of the lateral stop edges for the ends of the compression spring.

14. A pulse generator comprising a gear, and an actuating member having a projection which engages a tooth space of the gear in the rest position and which is deflectable toward one side or the other depending on the direction of rotation of the gear, with said actuating member being capable of actuating one of two laterally disposed contacts in each of its deflected positions; and wherein: said actuating member is made of insulating material and is movable both sideways and in the direction of the teeth of the gear; a compression spring designed as a pressure and restoring spring is provided which presses said actuating member against the teeth of the gear and which forces the projection into engagement with the tooth space in the rest position; and said actuating member is provided, on a side remote from the teeth, with a groove in which the compression spring, designed as a leaf spring, is inserted.

* * * * *